United States Patent [19]

Breslow

[11] 3,984,105

[45] Oct. 5, 1976

[54] GAME APPARATUS

[75] Inventor: Jeffrey D. Breslow, Highland Park, Ill.

[73] Assignee: Marvin Glass & Associates, Chicago, Ill.

[22] Filed: July 29, 1974

[21] Appl. No.: 492,526

[52] U.S. Cl. ..... 273/130 AB; 46/253; 272/31 R; 273/1 E

[51] Int. Cl.[2] ..... A63H 17/00

[58] Field of Search ..... 273/1 R, 1 E, 1 M, 130, 273/86 R, 86 H; 272/31 R; 46/243 R, 243 M, 243 LV, 243 P, 244

[56] References Cited

UNITED STATES PATENTS

| | | | |
|---|---|---|---|
| 1,125,818 | 1/1915 | Cooley | 273/86 H |
| 2,750,683 | 6/1956 | Theobald | 273/1 E |
| 2,792,224 | 5/1957 | White | 272/31 R X |
| 3,273,889 | 9/1966 | Brass et al. | 273/1 E |
| 3,706,153 | 12/1972 | Folson et al. | 272/31 R UX |
| 3,734,497 | 5/1973 | Brown | 272/31 R X |
| 3,822,880 | 7/1974 | Terzian et al. | 272/31 R |

FOREIGN PATENTS OR APPLICATIONS

| | | | |
|---|---|---|---|
| R14,548 | 10/1955 | Germany | 272/31 R |
| 447,791 | 4/1949 | Italy | 273/86 H |
| 639,458 | 6/1950 | United Kingdom | 272/31 R |

OTHER PUBLICATIONS

Faller Catalog, pp. 41–48, Mar. 1970.

*Primary Examiner*—Paul E. Shapiro
*Attorney, Agent, or Firm*—Coffee & Sweeney

[57] ABSTRACT

An amusement device or toy which includes a vehicle, such as a toy motorcycle, attached by a tethering arm to a generally upright base support in the center of a game board. A path of travel for the vehicle is defined on the game board about the base support and a plurality of playing pieces or obstacles such as ramps, barrels, and tires are positionable on the game board in the defined path of travel to change the operating characteristics of the vehicle, as performing "stunts." A centrally disposed variable speed motor is provided to drive the vehicle and tethering arm about the game board. A deck of playing cards is provided which instruct the players of the game which playing pieces or obstacles are to be placed along the path of travel and successfully maneuver in order to obtain points.

11 Claims, 5 Drawing Figures

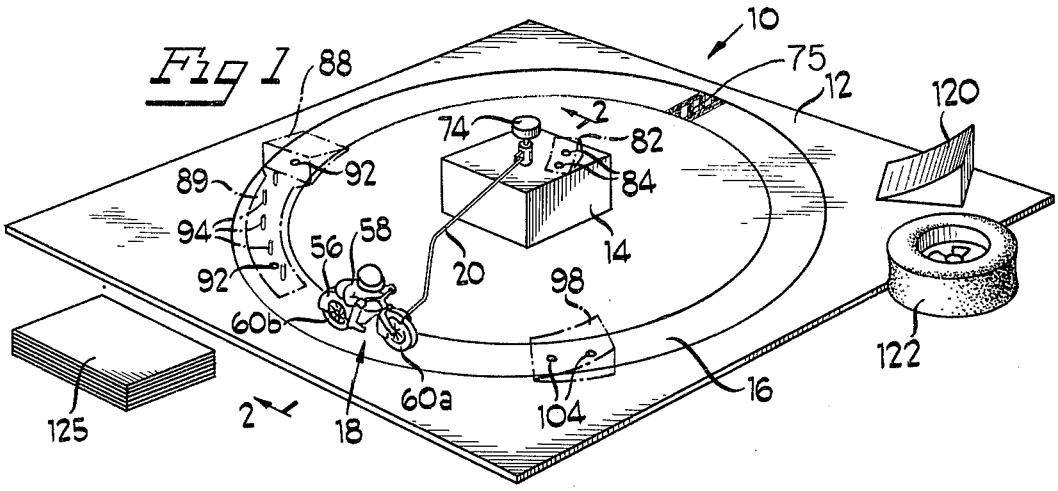
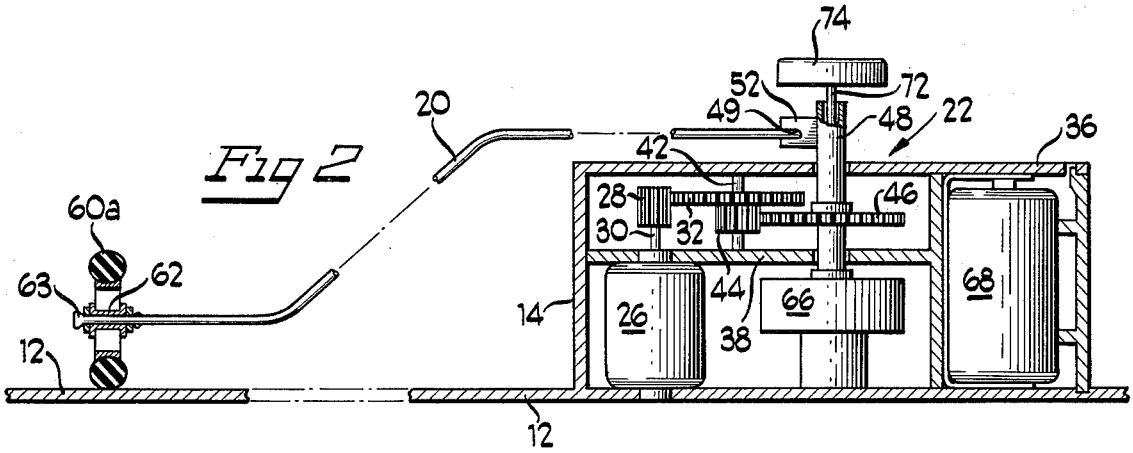
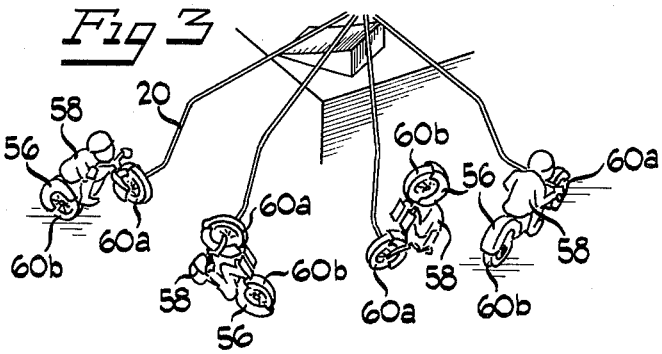
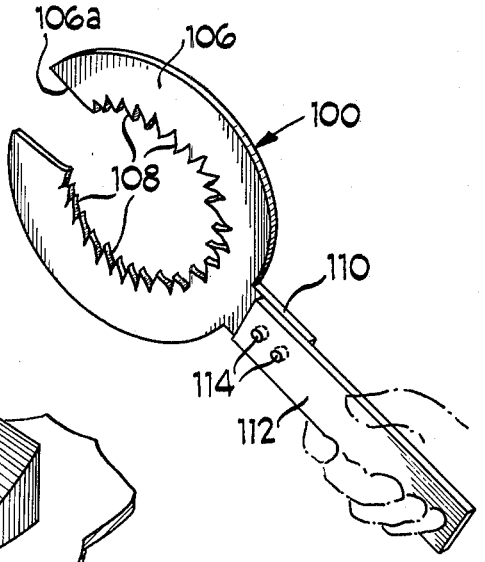
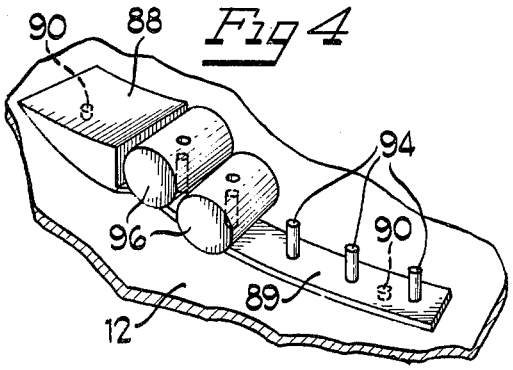
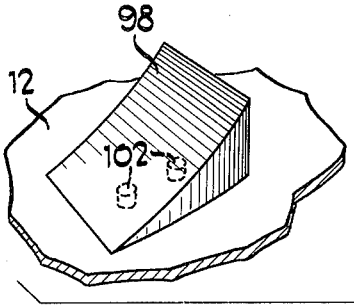
Fig 5

GAME APPARATUS

BACKGROUND OF THE INVENTION

The present invention pertains generally to the field of toy vehicles and the like, and particularly to a board game employing vehicles which are secured to a central base support by a tethering line or arm where the central support has a shaft which rotates to drive the toy vehicle in a generally circular or orbital path of travel about the support.

Devices have been produced where a vehicle is tethered to a central pylon for generally circular travel about the pylon, particularly in the field of model airplanes or the like. In most of these devices, the object simply is to cause the vehicle to circle the pylon with little or no participation on the part of the user, except in some cases for possible speed or height variance, or sometimes radius variances. Such devices have little or no competitive value and soon lose their interest appeal.

An object of the present invention is to provide a novel combination of tethered vehicle with a plurality of playing pieces which cooperate with the toy vehicle to produce different operating characteristics and paths of travel therefor.

In the exemplary embodiment of the invention, the amusement device includes, in combination, a game board having a base support generally at its center and an orbital path of travel defined on the board about the base support. A wheeled vehicle is connected to the base support by a tethering arm so as to control the direction of travel generally about the base support, and drive means is provided to rotate the tethering arm and toy vehicle. Stations are defined on the game board along the defined path of travel, and a plurality of playing pieces and/or obstacles are positionable at one of the stations for engagement by the vehicle to effect different operating characteristics and/or stunts of the toy vehicle. Playing cards are used to determine the play of the game, including which playing pieces or obstacles are to be placed along the path of travel and successfully maneuvered to obtain points, for instance.

Other objects, features and advantages of the invention will be apparent from the following detailed description taken in connection with the accompanying drawings.

BRIEF DESCRIPTION OF THE DRAWINGS

FIG. 1 is a perspective view of the amusement device of the present invention;

FIG. 2 is a fragmented vertical section, on an enlarged scale, taken generally along the line 2—2 of FIG. 1;

FIG. 3 is a somewhat schematic perspective view of the toy vehicle, with tethering arm in engagement with one of the playing pieces, showing multiple sequential positions of the rotational movement of the toy vehicle;

FIG. 4 is a perspective view, on an enlarged scale, of one of the playing pieces including barrels behind a ramp over which the vehicle must pass; and FIG. 5 is a perspective view of another of the playing pieces showing a ramp and a simulated "ring of fire" through which the vehicle must pass.

BRIEF DESCRIPTION OF THE PREFERRED EMBODIMENT

The amusement device, generally designated 10, of the present invention as seen in FIG. 1 of the drawings, generally includes a game board 12 having a generally hollow base support 14 at its center and a circular track or path of travel 16 equidistant from and about the base 14. The amusement device 10 also includes a toy motorcycle, generally designated 18, which is connected by tethering means, in the form of an arm 20, to the base 14, as will be described hereinafter.

Drive means, generally designated 22, is provided within the base 14 to drive the toy motorcycle 18, through the arm 20, around the track 16. The drive means 22 includes an electric motor 26 having a pinion gear 28 on the upper end of a motor shaft 30. The pinion gear 28 is in meshing engagement with an adjacent idler gear 32 rotatably supported by a shaft 42 between a top wall 36 and an interior rib 38 of the base 14. Another pinion gear 44 is secured to shaft 42 in meshing engagement with a main drive gear 46. Drive gear 46 is secured to journal means in the form of a hollow rotatable shaft 48 which is also rotatably mounted between the top wall 36 and the rib 38 of the base 14. A horizontal radial boss 52 is provided at the uppermost end of the hollow shaft 48 and includes a side transverse (i.e., perpendicular to arm 20) hole 49 into which a transverse inner end portion of the tethering arm 20 is pivotally secured. This arrangement allows for pivoting to the tethering arm 20 in a vertical direction upwardly from the game board 12. While the tethering arm 20 is shown in the exemplary embodiment as being a generally rigid offset connecting member, it is also contemplated with certain features of the invention that a flexible, guide line type tethering means could be used, with the power in the vehicle itself.

The toy motorcycle 18 (FIG. 1) includes a frame 56 having a riding figure 58 mounted thereon, with front and rear rotatable ground engageable wheels **60*a* and 60*b*, respectively, rollingly supporting the frame. Referring to FIG. 2, the front wheel 60*a* of the motorcycle 18 includes a bearing 62 in the center of the hub of the wheel for rotatably receiving the outermost end of the tethering arm 20. An enlargement 63 on the end of the tethering arm prevents the motorcycle from sliding off the tethering arm. Thus, the motor 26 causes the toy motorcycle to rotate about the track 16, through the tethering arm 20**.

A rheostat 66, or similar speed control device, is connected in series with the motor 26 and a power supply, such as one or more batteries 68. The rheostat 66 has an upwardly directing control shaft 72 within shaft 48, with a knob 74 on the end of shaft 72 for adjusting the speed of the motor by hand rotation of the knob 74. The rheostat has an "off" position which completely stops the motor. With the rheostat 66, a user may start the toy motorcycle 18 for movement about the path of travel defined by track 16 and can control the speed at which the motorcycle will rotate about the base 14. A "stop" station 75 is provided on the track 16 to permit attempts at stopping the vehicle only at the stop station.

A plurality of playing pieces are shown in FIGS. 1, 3, 4 and 5. The playing pieces of FIGS. 3, 4 and 5, on the track 16, are shown in phantom in FIG. 1.

More particularly, referring to FIGS. 1 and 3, a playing piece in the form of a cam or a ramp 82 is provided with two depending pins 84 (FIG. 1) which engage two holes in the top wall 36 of the base. The ramp 82 will engage the tethering arm 20 as it sweeps that quadrant of the game board 12 and will cause the front wheel of the motorcycle 18 to lift from the playing surface. As the tethering arm continues up the ramp 82, the toy motorcycle 18 will make a complete revolution or somersault about the rotational connection 62 at the end of the tethering arm 20. The operation of the ramp 82 on the motorcycle is seen in a series of four positions in FIG. 3. The mass of the motorcycle behind the front wheels and the operation of the ramp, depending on the operational speed, will effect the somersault.

Referring now to FIG. 4, another playing piece is shown, including a cam or camp 88 having an arcuate elongated lip portion 89 secured thereto, both of which are positionable on the track 16 by pins 90 engaging holes 92 (FIG. 1) on the game board in the track 16. The playing piece also includes a plurality of upstanding pins 94 on the lip portion 89 which support a plurality of simulated barrels 96 (comprising auxiliary playing pieces) over which the motorcycle must pass or "jump" as it leaves the ramp 88.

Referring to FIG. 5, another playing piece combination is shown including a cam or ramp 98 and a simulated ring of fire, generally designated 100. The ramp 98 is positionable on the track by means of depending pins 102 interengaging a pair of holes 104 (FIG. 1) on the game board in the track 16. The ring of fire includes a substantially closed ring 106 (with a gap **106*a* for the arm 20) which has a plurality of teeth 108 directed inwardly from the ring, simulating the flames of a fire. A tab portion 110 of the ring is frictionally supported in a hand manipulatable handle 112 by means of a pair of pins 114 on the tab portion 110 received in complementary holes in the handle 112. As the toy motorcycle 18 engages the ramp 98 and leaves the surface of the track 16, the player must manipulate the ring of fire 100 so as to allow the toy motorcycle 18 to pass through the center of the ring. Failure of the motorcycle 18 or arm 20 to clear the ring 100 will cause the ring 100 to disengage from the handle 112**.

Another playing piece is shown to the right of FIG. 1 and includes a stationary cam or ramp 120 and a tire 122. The ramp 120 is oblique to the track 16 and the player must attempt to allow the tire 122 to roll down the ramp and cross the track 16 without interfering with the toy motorcycle 18.

Referring to FIG. 1, a deck of instruction cards 125 is provided which direct or instruct the players to use a certain playing piece, or combination of playing pieces, when attempting to complete one or a plurality of revolutions of the motorcycle 18 about the base 14. It is realized that some of the playing pieces provide more difficult obstacles or stunts than others and therefore the required use of different playing pieces may be awarded with a different number of points or a score for successful completion thereof.

The foregoing detailed description has been given for clearness of understanding only and no unnecessary limitations should be understood therefrom as some modifications will be obvious to those skilled in the art.

I claim:

1. An amusement device comprising, in combination:

a base having journal means thereon;

a wheeled vehicle;

an elongated rigid tethering arm between the vehicle and the journal so as to control the direction of travel of said vehicle about the journal generally transverse to the longitudinal axis of the tethering arm;

means for powering the vehicle and tethering arm about the journal; and cam means within the path of travel of the tethering arm, said cam means being engageable with said tethering arm to effect the operating characteristics of the vehicle.

2. The amusement device of claim 1 wherein the cam means is a manually manipulatable ramp positionable in the path of travel of the tethering arm which causes the vehicle to pass thereover through the air and the tethering arm is connected to the vehicle eccentric to the center of gravity thereof whereby the ramp and the off-center mass of the vehicle causes the vehicle to rotate about said arm after leaving the ramp.

3. An amusement device comprising, in combination:

a game board having a base support and means defining a path of travel on the board about the base support;

a wheeled vehicle connected to the base support by an elongated rigid tethering arm rotatably secured to the base support so as to control the direction of travel of said vehicle about the base support generally transverse to the longitudinal axis of the arm along said path of travel;

drive means to rotate the tethering arm to thereby drive the vehicle along the path of travel;

means defining stations on the game board; and a plurality of playing pieces, the playing pieces being positionable at at least one of the stations for engagement by the vehicle to effect different operating characteristics of the vehicle, at least one of the playing pieces includes the combination of cam means and a rollable object, the object being positionable on and directed by the cam means generally across the path of travel as an obstacle to the vehicle movement.

4. An amusement device comprising, in combination:

a game board having a base support and means defining a path of travel on the board about the base support;

a wheeled vehicle connected to the base support by an elongated rigid tethering arm rotatably secured to the base support so as to control the direction of travel of said vehicle about the base support generally transverse to the longitudinal axis of the arm along said path of travel;

drive means to rotate the tethering arm to thereby drive the vehicle along the path of travel;

means defining stations on the game board; and a playing piece positionable at one of said stations disposed within the inner periphery of the path of travel of the rigid arm, and said playing piece including cam means positionable at said station and engageable by the arm to effect various operating characteristics of the vehicle.

5. The amusement device of claim 4 wherein the cam means is a ramp positionable in the path of travel of the tethering arm and the tethering arm is connected to the vehicle eccentric to the center of gravity thereof whereby the ramp and the off-center mass of the vehicle causes the vehicle to rotate in a plane perpendicular to the arm.

6. An amusement device comprising, in combination:

a game board having a base support and means defining a path of travel on the board about the base support;

a wheeled vehicle connected to the base support by an elongated tethering arm rotatably secured to the base support so as to control the direction of travel of said vehicle about the base support generally transverse to the longitudinal axis of the arm along said path of travel;

drive means to rotate the tethering arm to thereby drive the vehicle along the path of travel;

means defining stations on the game board;

a plurality of playing pieces, the playing pieces being positionable at at least one of the stations for engagement by the vehicle to effect different operating characteristics of the vehicle; and instruction means to identify which playing piece or combination of playing pieces are to be positioned at said stations.

7. An amusement device comprising, in combination:

a game board having a base support and means defining a path of travel on the board about the base support;

a wheeled vehicle;

elongated tethering means between the vehicle and the base support so as to control the direction of travel of the vehicle about the base support generally transverse to the longitudinal axis of the tethering means;

means for powering the vehicle about the base support;

means defining stations on the game board; and a plurality of playing pieces, the playing pieces being positionable at one of the stations to effect different operating characteristics of the vehicle, at least one of the playing pieces including the combination of cam means and a rollable object, the object being positionable on and directed by the cam means generally across the path of travel as an obstacle to the vehicle's movement.

8. An amusement device, comprising, in combination:

a game board having a base support and means defining a path of travel on the board about the base support;

a wheeled vehicle connected to the base support by an elongated rigid tethering arm rotatably secured to the base support so as to control the direction of travel of said vehicle about the base support generally transverse to the longitudinal axis of the arm along said path of travel;

drive means to rotate the tethering arm to thereby drive the vehicle along the path of travel;

means defining stations on the game board, at least one of the stations being defined on said path of travel; and a plurality of playing pieces, the playing pieces being positionable at at least one of the stations for engagement by the vehicle to effect different operating characteristics of the vehicle, one of said playing pieces comprising cam means positionable at said station in said path of travel to cause the vehicle to momentarily leave the surface of the game board and at least one auxiliary playing piece comprising a hand manipulatable, substantially open ring through which the vehicle must pass through the air after leaving the cam means.

9. The amusement device of claim 5 wherein the ring includes a plurality of inwardly directed teeth and is frictionally connected to a handle whereby contact by the vehicle or tethering arm with the ring will disengage the connection signalling a failure.

10. An amusement device comprising, in combination:

a game board having a base support and means defining a generally circular path of travel on the game board about the base support;

a wheeled vehicle having at least a pair of longitudinally aligned wheels for rollingly supporting the vehicle on the path of travel;

elongated tethering means between the vehicle and the base support to maintain the vehicle in a stable upright position and control the direction of travel of the vehicle about the base support along said path of travel generally transverse to the longitudinal axis of the tethering means;

means for powering the vehicle about the base support;

speed control means, including an on-off means, associated with said power;

a playing piece in the form of an upwardly inclined ramp positionable in said path of travel for engagement by the wheels of said vehicle and abruptly terminating to require the vehicle to momentarily leave the surface of the game board as it passes over the ramp through the air and back onto the game board regardless of the speed of the vehicle; and means connecting the elongated tethering means to a vehicle eccentric to the center of gravity thereof whereby the ramp and the off-center mass of the vehicle causes the vehicle to rotate in a plane perpendicular to the tethering means as it passes over the ramp through the air and back onto the game board.

11. The amusement device of claim 10 including a stop station on said path of travel, and on-off means associated with the drive means to permit attempts at stopping the vehicle only at the stop station.

* * * * *